US005359843A

United States Patent [19]

Herold et al.

[11] Patent Number: 5,359,843

[45] Date of Patent: Nov. 1, 1994

[54] METHOD AND APPARATUS FOR SUPPLYING EMPTY BOBBINS TO AND REMOVING YARN PACKAGES FROM TEXTILE MACHINES

[75] Inventors: Hans-Jörg Herold, Crimmitschauer; Gerald Rascher, Stieglitzweg; Joachim Schneider, Vielaw; Holger Wurlitzer, Feuerbachweg, all of Germany

[73] Assignee: Innovatex Automatisierungstechnik GmbH, Lichtentanne, Germany

[21] Appl. No.: 974,039

[22] Filed: Nov. 10, 1992

[30] Foreign Application Priority Data

Apr. 29, 1992 [DE] Germany ..... 4214001

[51] Int. Cl.[5] ..... D01H 9/04; D01H 9/00

[52] U.S. Cl. ..... 57/267; 57/273; 57/281

[58] Field of Search ..... 57/90, 281, 266, 267, 57/268, 270, 273, 274, 67

[56] References Cited

U.S. PATENT DOCUMENTS

| | | | |
|---|---|---|---|
| 3,935,699 | 2/1976 | Iida et al. | 57/270 X |
| 4,137,701 | 2/1979 | Herubel | 57/267 X |
| 4,369,621 | 1/1983 | Kogiso | 57/267 |
| 4,548,028 | 10/1985 | Araki et al. | 57/281 |
| 4,841,720 | 6/1989 | Kawasaki et al. | 57/281 |
| 5,022,223 | 6/1991 | Mena | 57/274 |
| 5,197,272 | 3/1993 | Frey | 57/281 X |
| 5,222,350 | 6/1993 | Bowman et al. | 57/281 X |

FOREIGN PATENT DOCUMENTS

| | | |
|---|---|---|
| 0310567 | 4/1989 | European Pat. Off. . |
| 0310568 | 4/1989 | European Pat. Off. . |
| 229165 | 10/1985 | German Dem. Rep. . |
| 1560317 | 7/1970 | Germany . |
| 3146040 | 6/1983 | Germany . |
| 3702265 | 7/1987 | Germany . |
| 3630214 | 3/1988 | Germany . |
| 284919 | 11/1990 | Germany . |
| 3936518 | 5/1991 | Germany . |

*Primary Examiner*—Daniel P. Stodola
*Assistant Examiner*—William Stryjewski
*Attorney, Agent, or Firm*—Jordan and Hamburg

[57] ABSTRACT

A method and an apparatus for doffing yarn packages from and supplying empty bobbins to a textile machine with a vertically movable bobbin rail with a bobbin bearing, a flyer inverted U-shaped revolving device and spindle with a spindle holding mechanism, a revolving, storage system with a storage hoist, which can be controlled by the textile machine and is above the spindle holding mechanism. Below the storage hoist, a bobbin creel is provided with mandrels for accommodating or transferring full packages or empty bobbins. The bobbin creel can be moved vertically up to the bobbin rail and can be pushed into the textile machine between the spindle and the bobbin rail. Within the bobbin rail a switching mechanism corresponds to the spindle holding mechanism. The spindle holding mechanism is, disposed within the spindle and is comprised of a latch. A switching element, corresponding to the latch is disposed within the spindle holding mechanism.

3 Claims, 4 Drawing Sheets

Figure 1:
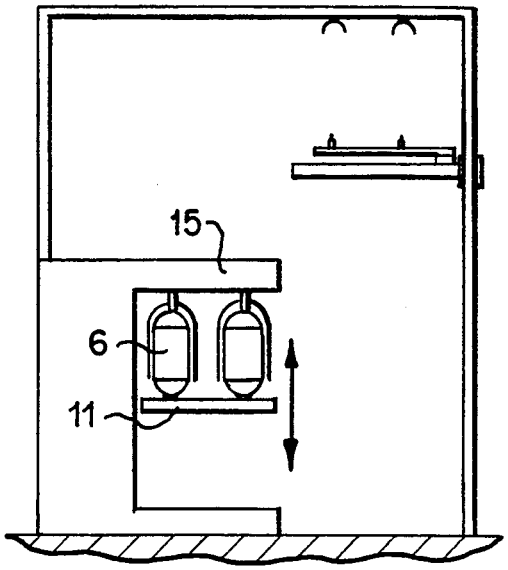

METHOD AND APPARATUS FOR SUPPLYING EMPTY BOBBINS TO AND REMOVING YARN PACKAGES FROM TEXTILE MACHINES

BACKGROUND OF THE INVENTION

The invention relates to a method and an apparatus for doffing yarn packages automatically from textile machines, particularly from a slubbing machine and replacing them with empty bobbins using conventional storage systems with transporting equipment.

German patent 37 02 265 discloses a method and an apparatus for automatically doffing yarn packages from a slubbing machine and replacing them with empty bobbins in which the yarn packages are lowered into a position outside of the flyer and placed upon the pins of a conveyor, which are arranged in zigzag fashion. The conveyor is then moved a certain distance and the empty bobbins, which were previously placed on the conveyor, are doffed and conveyed on the lowered yarn package carriage, which is then raised into its operating position. At the same time, the lowered yarn packages, aligned obliquely, are raised from their positions, aligned vertically once again and then placed down on the conveyor. The empty bobbins are then raised from the conveyor, lowered in an oblique alignment onto the yarn package carriage and then aligned once again with the axis of rotation of the yarn package rotors. The gripping apparatus for the yarn packages and the empty bobbins has a carriage which can be moved along the front side of the machine.

On the carriage, an apparatus takes hold of the obliquely placed yarn packages, aligns them in a vertical direction and places them down on the conveyor and subsequently takes hold of the empty bobbins from the conveyor and places them down on the lowered, inclined yarn package carriage. The conveyor is essentially in the plane of a base plate of the machine in the vicinity of the lowered yarn package carriage.

German patent 39 36 518 discloses a slubbing machine with a flyer bank which carries a flyer inverted U-shaped revolving device and is disposed on a machine frame. The flyer bank is assigned to a bobbin rail which is supported on the machine frame so as to be movable vertically and horizontally. A transporting mechanism extends parallel to the bobbin rail and serves to supply empty bobbins and to carry away full ones. The bobbin rail can slide below the transporting mechanism and the transporting mechanism is at the same height as the flyer bank.

European patent 03 10 568 A 1 discloses a flyer with a bobbin rail which can be extended transversely to its longitudinal direction forwards out of the flyer. At the front of the flyer, there is a transporting mechanism for packages and empty bobbins, which runs above the flyer. To exchange the full packages for the empty bobbins from the bobbin rail to the transporting mechanism and from the transporting mechanism to the bobbin rail, the transporting mechanism is disposed so that it can be shifted vertically. All the full packages are doffed.

European patent 03 10 567 also discloses the doffing of the full packages in the upwards direction by means of an additional prior storage or conveying system.

A segmental doffing of the full packages from the tilted bobbin rail and transfer to a storage or conveying system disposed above the flyer, is described in DOS 36 30 214 and the DD 284 919.

From German patent 31 46 040, it is known that a conveying chain is disposed as an intermediate storage system in front of the flyer and a doffing apparatus for the packages is disposed in front of the flyer and all of the full packages are doffed in pairs, with transfer to a suspension conveying system.

These arrangements include the need for relatively expensive lifting and lowering apparatuses, in some cases with gripper and lever systems, at the front side of the flyer for the transporting apparatus with storage system disposed above the flyer. These lifting and lowering apparatuses require not only additional space, but also interfere with the accessibility during the whole of the spinning process. For segmental doting, the time required is affected significantly.

SUMMARY OF THE INVENTION

It is an object of the invention to avoid these disadvantages and to provide a method and an apparatus, which supplies yarn packages to and removes empty bobbins from textile machines and which makes it possible to ensure ready accessibility to the machine during the whole of the spinning process, while requiring little space, and to achieve short doffing times.

BRIEF FIGURE DESCRIPTION

Figure 13:
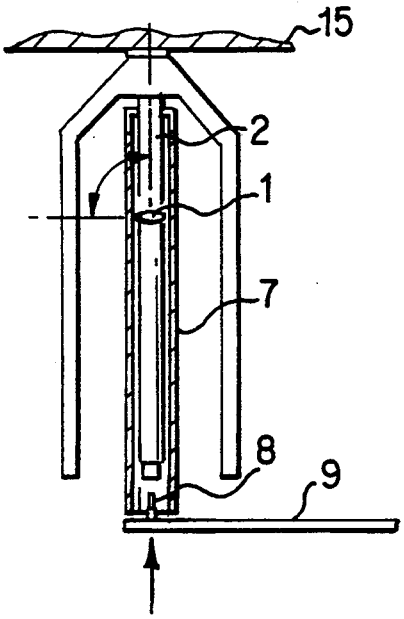
Figure 14:
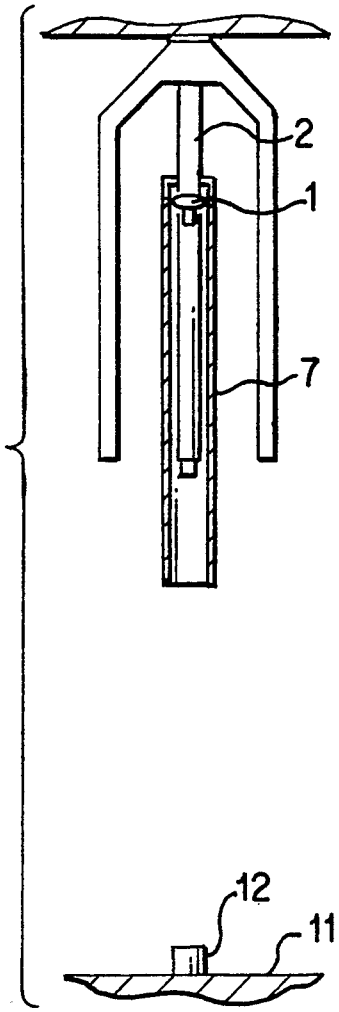
Figure 15:
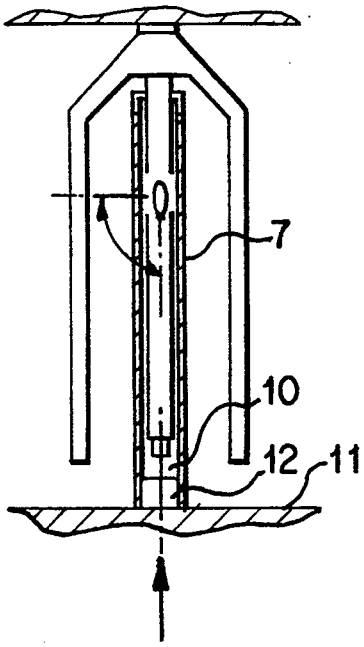

The invention will now be explained in greater detail below with reference to the drawings, wherein:

FIGS. 1 to 8 illustrate sequential process steps for removing yarn packages from and supplying empty bobbins to the demonstration model of a flyer and FIGS. 9 to 15 show the process steps of the spindle holding mechanism, FIGS. 9 to 12 representing the steps of removing the full yarn packages and FIGS. 13 to 15 representing the supplying of empty bobbins.

DISCLOSURE OF THE PREFERRED EMBODIMENTS

The process steps in the disclosed embodiment of a flyer are as follows:

The flyer 15 is working, the packages 6 are almost fully spooled; the vertically movable bobbin rail 11 still engages the packages 6. (FIG. 1)

Figure 2:
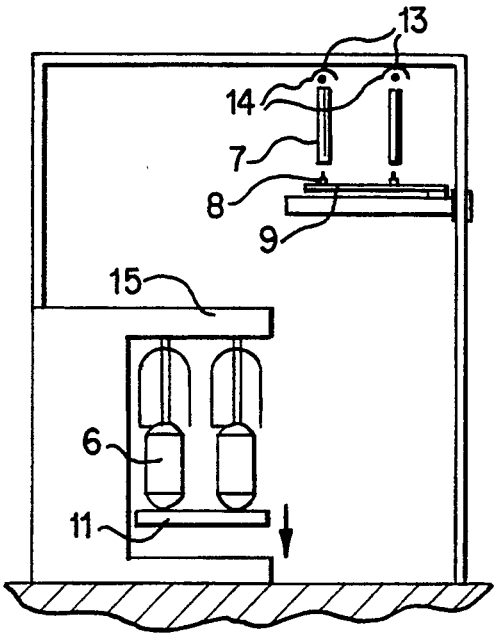

The impending exchange of bobbins is signaled to the storage system 13 at the flyer 15 by means of the control mechanism. A storage hoist 14 with twice the number of slots is made available directly over the bobbin creel 9 with mandrels 8. Each second slot is occupied by an empty bobbin 7; the bobbin rail 11 with the full packages 6 moves downwards. (FIG. 2)

Figure 3:
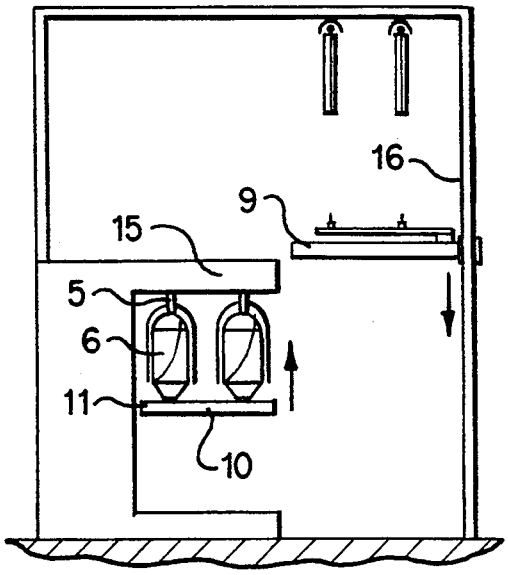

The winding up process of the packages 6 in the flyer is stopped and the slubbing separation, which is not shown, is carried out. The bobbin rail 11 subsequently moves upwards and locks the spindle holding mechanism 5 by means of the switching mechanism 10. The bobbin creel 9 is lowered at the columns 16 in front of the flyer 15 to the height of the bobbin rail 11. (FIG. 3)

Figure 4:
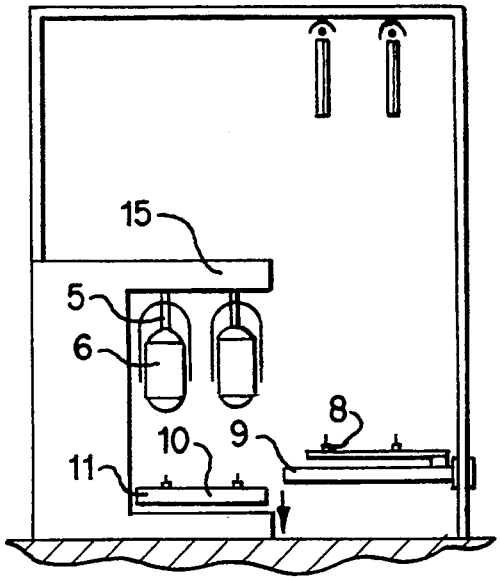

The bobbin rail 11 with the switching mechanism 10 is lowered, the package 6 remains suspended at the spindle holding mechanism 5 and becomes free from below, so that it can be accommodated on the mandrel 8 of the bobbin creel 9 that has been run into the flyer 15. (FIG. 4)

Figure 5:
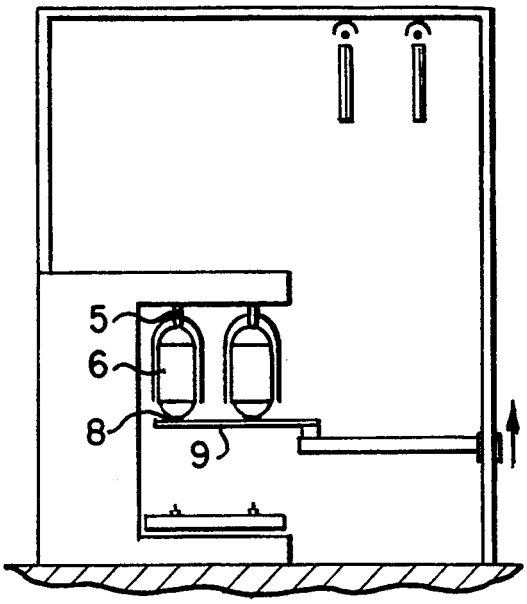

The bobbin creel 9, which has been run into the flyer 15, is raised, the mandrels 8 take hold of the full packages 6 and unlock the spindle holding mechanisms 5, which release the full packages 6. (FIG. 5)

Figure 6:
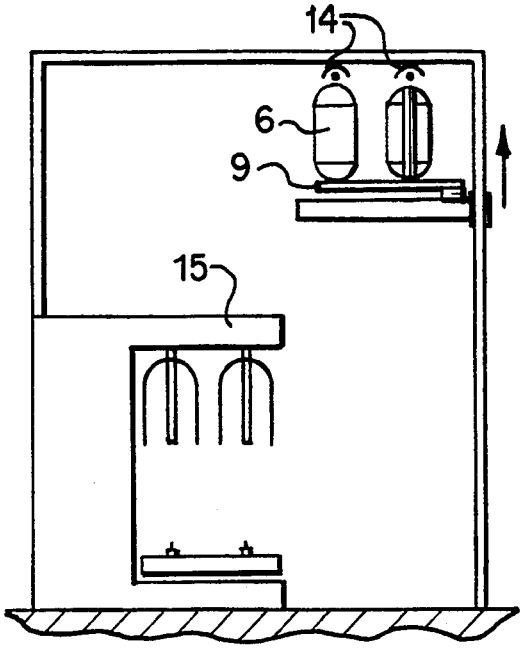

The bobbin creel 9 is lowered, moved out of the flyer 15, moved to the empty slots of the storage hoist 14 and the full packages 6 are fastened to these slots. (FIG. 6)

Figure 7:
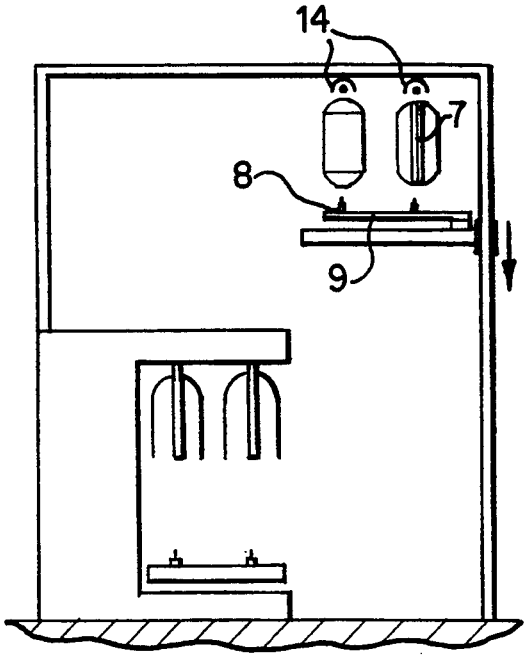

The bobbin creel 9 is moved slightly out of the region of the storage hoist 14, the storage hoist 14 is shifted by half a machine division, the empty bobbins 7 are above the mandrels 8 of the bobbin creel 9. (FIG. 7)

Figure 8:
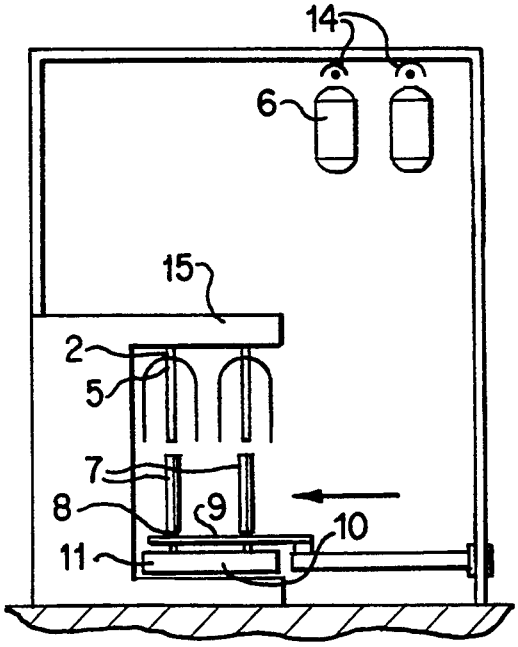
Figure 9:
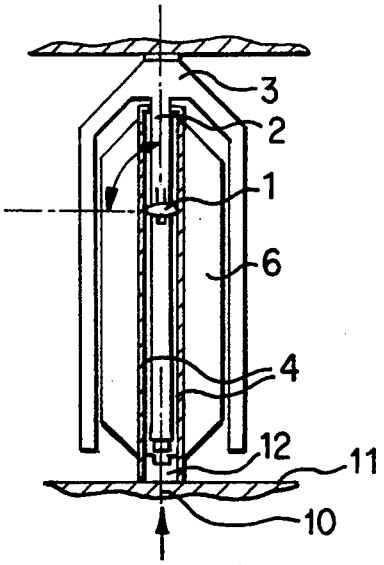
Figure 10:
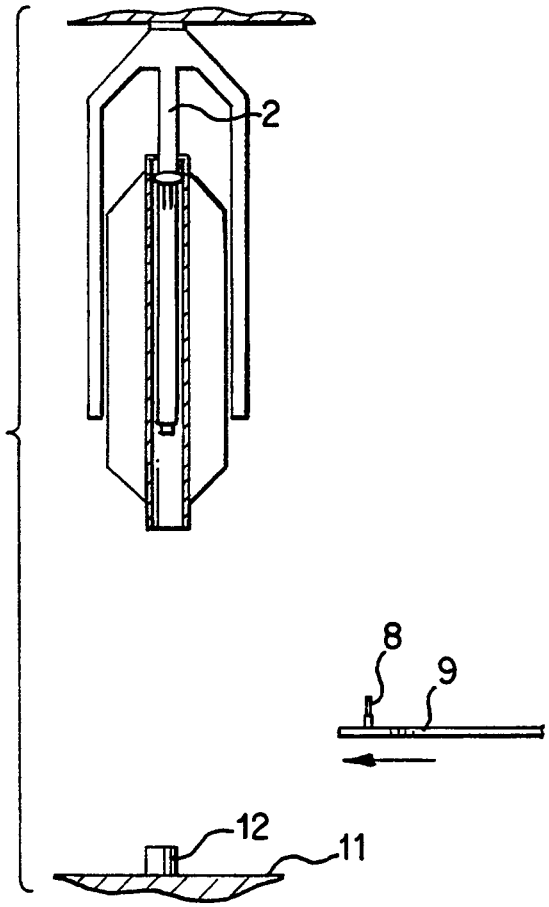
Figure 12:
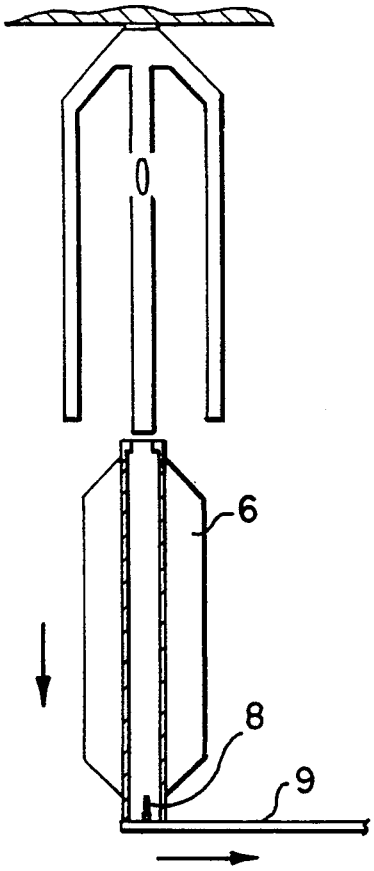
Figure 11:
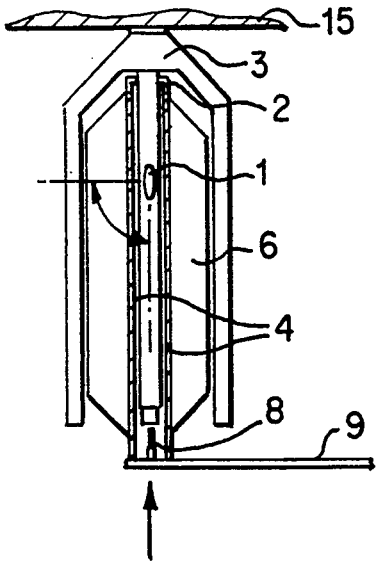

Due to the lifting motion of the bobbin creel 9, the empty bobbins 7 are removed from the storage hoist 14 and the bobbin creel 9 is lowered to be level with the bobbin rail 11 and is guided into the flyer 15 below spindles 2. Due to the lifting motion of the bobbin creel 9, the empty bobbins 7 are creeled onto the spindles 2 and the holding mechanism is locked by mandrels 8. The bobbin creel 9 subsequently is lowered again, moved out of the flyer 15 and brought to the top into the waiting position. The bobbin rail 11 moves to the top and unlocks spindle holding mechanism 5 by means of the switching mechanism 10. Subsequently, the spinning of the roving yarn slubbing onto the empty bobbins 7 is started and the full packages 6 are moved on. (FIG. 8)

The process steps of the spindle holding mechanism 5 are:

The latch 1 of the spindle 2 of the flyer inverted U-shaped revolving device 3 is operated by the movement of the switching element 4 at the end of the spindle 2 and causes the full package 6 as well as the empty bobbin 7 to be seated tightly on the spindle 2.

The switching mechanism 10 of the bobbin rail 11 and the mandrel 8 on the bobbin creel 9 actuate this switching element 4 during the removal of the full package 6 and the supplying of the empty bobbins 7.

The removal of the full packages comprises the following steps:

When the package 6 is full, the switching mechanism 10 of the bobbin rail 11 locks the spindle holding mechanism 5.

The bobbin rail 11 is lowered, tile package 6 arrested at the spindle 2 of the flyer inverted U-shaped revolving device 3 and is detached from the bobbin bearing 12 of the bobbin rail 11.

The bobbin creel 9, introduced into the flyer 15, unlocks the spindle holding mechanism 5 by means of the mandrels 8 and the package 6 is taken over by the bobbin creel 9. (FIGS. 9 to 12)

The delivery of empty bobbins comprises the steps:

Delivering the empty bobbins 7 by the bobbin creel 9 into the flyer 15. In so doing, the mandrel 8 locks the spindle holding mechanism 5. The latch 1 arrests the empty bobbin 7 on the spindle 2, the bobbin creel 9 leaves the delivery area.

The bobbin rail 11 moves to the top, takes hold of the empty bobbin 7 with the bobbin bearing 12 and unlocks the spindle holding mechanism 5 by actuating the switching mechanism 10: the winding process can take place on the empty bobbins 7. (FIGS. 13 to 15)

The apparatus comprises a flyer 15 with a vertically movable bobbin rail 11 with bobbin bearing 12, flyer inverted U-shaped revolving device 3 and spindle 2 with a spindle holding mechanism 5. Above the flyer 15 there is a revolving control system 13 with storage hoist 14 with double the number of slots. The storage system 13 can be controlled by the flyer 15. Directly below the storage hoist 14, a bobbin creel 9 with mandrels 8 for accommodating the full packages 6 or the empty bobbins 7 is disposed. This bobbin creel 9 can be moved vertically at columns 16, which are located in front of the flyer 15, up to the bobbin rail 11 and can be pushed into the flyer 15 between spindle 2 and bobbin rail 11. Within the bobbin rail 11, there is a switching mechanism 10 consisting of a lifting mechanism, which is not shown and corresponds to the spindle holding mechanism 5.

The spindle holding mechanism 5, which is disposed within the spindle 2, consists of a latch 1 in the form of a hasp, which can be swivelled through 90°. Furthermore, a switching element 4, which corresponds with the latch 1, is disposed within the spindle holding mechanism 5.

The textile machine accordingly is readily accessible during the whole of the spinning process, since there is no intermediate storage system in front of the machine, but only a suspended storage system above the machine. Due to the total doffing of the packages, the doffing times are very short. The storage of packages/bobbins in the spindle holding mechanism can be brought about quickly and the removal mechanism is readily accessible. The problem of the triggering mechanism for packages and bobbins is solved advantageously. The bobbin creel is especially advantageous because of its simplicity. The segmental construction according to a modular principle permits adaptation to textile machines of any size while maintaining the total doffing, The invention can be adapted to existing suspension conveyor systems.

We claim:

1. A method for doffing yarn packages from and supplying empty bobbins to textile machines, in which the full packages from a bobbin rail are guided and detachably anchored at a storage system with a transporting mechanism above the textile machine and the empty bobbins are guided and detachably anchored by the storage system at the bobbin rail, and a moving means for moving the bobbin rail in a vertical direction, said method comprising:

signalling an impending exchange of bobbins to the storage system at the textile machine by means of a control mechanism, making ready a storage hoist directly over a bobbin creel with mandrels, moving the bobbin rail with the full packages downwards, ending a winding up process of the packages, including slubbing, separation between the full package and the textile machine, moving the bobbin rail upwards and locking a spindle holding mechanism by means of a switching mechanism, lowering the bobbin creel at columns in front of the textile machine to a height of the bobbin rail, lowering the bobbin rail with the switching mechanism, whereby the package remains suspended at the spindle holding mechanism and becomes free from below, so that it can be supported on the mandrel of the bobbin creel that is moving into a spinning station of the textile machine, raising the bobbin creel, which has been moved into the textile machine, whereby the mandrels take hold of the full packages and unlock the spindle holding mechanisms to release the full packages, lowering the bobbin creel, moving it out of the textile machine, moving it to empty slots of the storage hoist and fastening the full packages thereto, moving the bobbin creel slightly out of a region of the storage hoist, and shifting the storage hoist, whereby the empty bobbins are above the mandrels of the bobbin creel, removing the empty bobbins of the bobbin creel from the storage hoist by the lifting motion of the bobbin creel, lowering the bobbin creel with the empty bobbins to a level of the bobbin rail and guiding them into the textile machine below the spindles, mounting the empty bobbins onto the spindles by the lifting motion of the bobbin creel and locking their holding mechanism by the mandrels, subsequently lowering the bobbin creel again, moving it out of the textile machine and bringing it to an above waiting position, moving the bobbin rail upwards and unlocking the spindle holding mechanism by means of the switching mechanism, and subsequently, commencing the spinning of roving yarn slubbing on the empty bobbins.

2. The method of claim 1 further comprising these steps within the spindle holding mechanism:

operating a latch of a spindle flyer inverted U-shaped revolving device by movement of the switching element at a end of the spindle for fastening the full package as well as the empty bobbin in the spindle, employing the switching mechanism of the bobbin rail and the mandrel on the bobbin creel to actuate a switching element during the removal of the full packages and the supplying of the empty bobbins, when the package is full, locking the spindle holding mechanism with the switching mechanism of the bobbin rail, lowering the bobbin rail, arresting the full package at the spindle and detaching it from a bobbin bearing of the bobbin rail, introducing the bobbin creel into the textile machine to unlock the spindle holding mechanism by means of the mandrels, thereby enabling the bobbin creel to take over the package, while the empty bobbins are being delivered by the bobbin creel into the textile machine, locking the spindle holding mechanism with the mandrel, arresting the empty bobbin on the spindle with the latch, and moving the bobbin creel from a delivery area, moving the bobbin rail up, so that it takes hold of the empty bobbin with the bobbin bearing and unlocks the spindle holding mechanism by actuating the switching mechanism so that the empty bobbins are capable of undergoing a winding-up process.

3. An apparatus for removing yarn packages from and supplying empty bobbins to a textile machine comprising a vertically movable bobbin rail, a flyer inverted U-shaped revolving device and a spindle with a spindle holding mechanism and, above the textile machine, a revolving, controllable storage system with a storage hoist with double a number of slots, a bobbin creel below the storage hoist with mandrels for accommodating full packages or the empty bobbins, said bobbin creel being movable vertically up to the bobbin rail and being mounted to be pushed into the textile machine between the spindle and the bobbin rail for accommodating full packages or empty bobbins, and a switching mechanism with a lifting mechanism which corresponds to the spindle holding mechanism, said switching mechanism being within the bobbin rail and operating to move the bobbin rail upwards and lock the spindle holding mechanism, the spindle holding mechanism being disposed within the spindle and being comprised of a latch, and a switching element which corresponds with the latch is disposed within the spindle holding mechanism and operates to actuate the spindle holding mechanism.

* * * * *